US010117533B2

(12) United States Patent
Chen et al.

(10) Patent No.: US 10,117,533 B2
(45) Date of Patent: Nov. 6, 2018

(54) STRAW CUP

(71) Applicant: Helen of Troy Limited, Belleville, St. Michael (BB)

(72) Inventors: Tiffany Chang Chen, New York, NY (US); Vicente Jorge Valderrama, Staten Island, NY (US)

(73) Assignee: Helen of Troy Limited, St. Michael (BB)

( * ) Notice: Subject to any disclaimer, the term of this patent is extended or adjusted under 35 U.S.C. 154(b) by 93 days.

(21) Appl. No.: 15/166,422

(22) Filed: May 27, 2016

(65) Prior Publication Data

US 2017/0340148 A1 Nov. 30, 2017

(51) Int. Cl.

| | |
|---|---|
| ***A47G 19/22*** | (2006.01) |
| ***A47G 21/18*** | (2006.01) |
| ***B65D 47/32*** | (2006.01) |

(52) U.S. Cl.

CPC ..... *A47G 19/2272* (2013.01); *A47G 21/18* (2013.01); *B65D 47/32* (2013.01)

(58) Field of Classification Search

CPC ..... A47G 19/2272; A47G 21/18; B65D 47/32
See application file for complete search history.

(56) References Cited

U.S. PATENT DOCUMENTS

| | | | | |
|---|---|---|---|---|
| 4,714,173 | A | 12/1987 | Ruiz | |
| 5,178,613 | A * | 1/1993 | Gibilisco | A61F 9/0008 215/206 |
| 5,234,117 | A * | 8/1993 | Garvin | A47G 21/18 215/11.1 |
| 6,196,413 | B1 | 3/2001 | Tung | |
| 6,250,487 | B1 | 6/2001 | Tebeau | |
| 6,915,961 | B2 | 7/2005 | Renz et al. | |
| 6,929,135 | B1 | 8/2005 | Hajianpour | |
| 7,516,862 | B2 | 4/2009 | McDonough | |
| 7,748,643 | B2 | 7/2010 | Renz et al. | |
| 8,186,537 | B2 | 5/2012 | Rosnak et al. | |

(Continued)

FOREIGN PATENT DOCUMENTS

| | | |
|---|---|---|
| CN | 205041146 | 2/2016 |
| JP | 2013-112378 | 6/2013 |

OTHER PUBLICATIONS

International Search Report filed in PCT/US2017/027159 dated Jul. 14, 2017.

*Primary Examiner* — Andrew T Kirsch
(74) *Attorney, Agent, or Firm* — Rankin, Hill & Clark LLP

(57) ABSTRACT

A straw cup includes a container and a lid releasably attached to the container for closing a container open top. A lid body has a dispensing port and a vent each extending therethrough. The body further has a downward depending inner collar which surrounds the dispensing port. A straw extends through the dispensing port and has a mounting member provided at a lower end thereof. The mounting member is received in the inner collar and includes a flexible seal member having a downward frusto-conical shape. The seal member normally contacts an inner surface of the inner collar. The seal member is movable radially downwardly and away from the inner surface allowing an inward flow of air through the vent and over the seal member upon the introduction of a pressure differential across the vent where the pressure outside of the container is greater than the pressure inside of the container.

19 Claims, 6 Drawing Sheets

(56) References Cited

U.S. PATENT DOCUMENTS

| | | | | |
|---|---|---|---|---|
| 8,191,727 | B2 | 6/2012 | Davies et al. | |
| 8,622,236 | B2 | 1/2014 | Sanbrook et al. | |
| 2005/0199637 | A1* | 9/2005 | Wong ..... | A47G 19/2266 220/714 |
| 2010/0127005 | A1 | 5/2010 | Sanbrook et al. | |
| 2011/0049169 | A1 | 3/2011 | Rosnak | |
| 2011/0062170 | A1 | 3/2011 | Kemper et al. | |
| 2013/0126527 | A1 | 5/2013 | Chiu | |
| 2014/0069944 | A1 | 3/2014 | Shapiro | |
| 2015/0008220 | A1 | 1/2015 | Wang | |
| 2016/0120343 | A1 | 5/2016 | Liang | |

* cited by examiner

STRAW CUP

BACKGROUND

Straw cups are very popular, and known straw cups typically include a container, a lid assembly selectively attachable to the container, and a straw assembly selectively attachable to the lid assembly. Often, the lid assembly is adapted to move the straw assembly between an operative position wherein the straw assembly is positioned for a user to drink from the cup, and a stowed position wherein the straw assembly is at least partially enclosed by the lid assembly and unavailable for the user to drink from the cup.

When liquid is withdrawn from the container, through the straw, a negative pressure may be created within the container, thus making it more difficult to further withdraw liquid. To address this problem, various types of vents have been used to allow air into the container and equalize the pressure between the inside of the container and the outside atmosphere. In addition to equalizing the relative pressure within a container, it may also be desirable to prevent liquid from escaping the container through the vent, if the cup is tilted or knocked over. It would be beneficial to provide a vented closure for a cup that allowed pressure equalizing air to enter the container and restricted unwanted outward flow of liquid from the container.

BRIEF DESCRIPTION

In accordance with one aspect, a straw cup for liquids comprises a drink container having an open top and a lid releasably attached to the container for closing the container open top. The lid includes a body having a dispensing port and a vent each extending therethrough. The body further has a downward depending inner collar which surrounds the dispensing port. A straw extends through the dispensing port and has a mounting member provided at a lower end thereof. The mounting member is received in the inner collar and includes a flexible seal member having a downward frusto-conical shape. The seal member normally contacts an inner surface of the inner collar. The seal member is movable radially downwardly and away from the inner surface allowing an inward flow of air through the vent and over the seal member upon the introduction of a pressure differential across the vent where the pressure outside of the container is greater than the pressure inside of the container.

In accordance with another aspect, a straw cup for liquids comprises a drink container having an open top, and a lid releasably attached to the container for closing the container open top. The lid includes a body having a dispensing port and a vent each extending therethrough. A straw extends through the dispensing port. A lower part of the straw includes a mounting member having a flexible seal member having a downward frusto-conical shape. The seal member normally contacts an inner part of the lid body. An upper surface of the mounting member is spaced from the lid body such that an airflow path is defined between the upper surface of the mounting member and the lid body. The seal member is movable radially downwardly and away from the inner part allowing an inward flow of air through each of the vent and the cutout and over the seal member upon the introduction of a pressure differential across the vent where the pressure outside of the container is greater than the pressure inside of the container.

DETAILED DESCRIPTION

Figure 1:
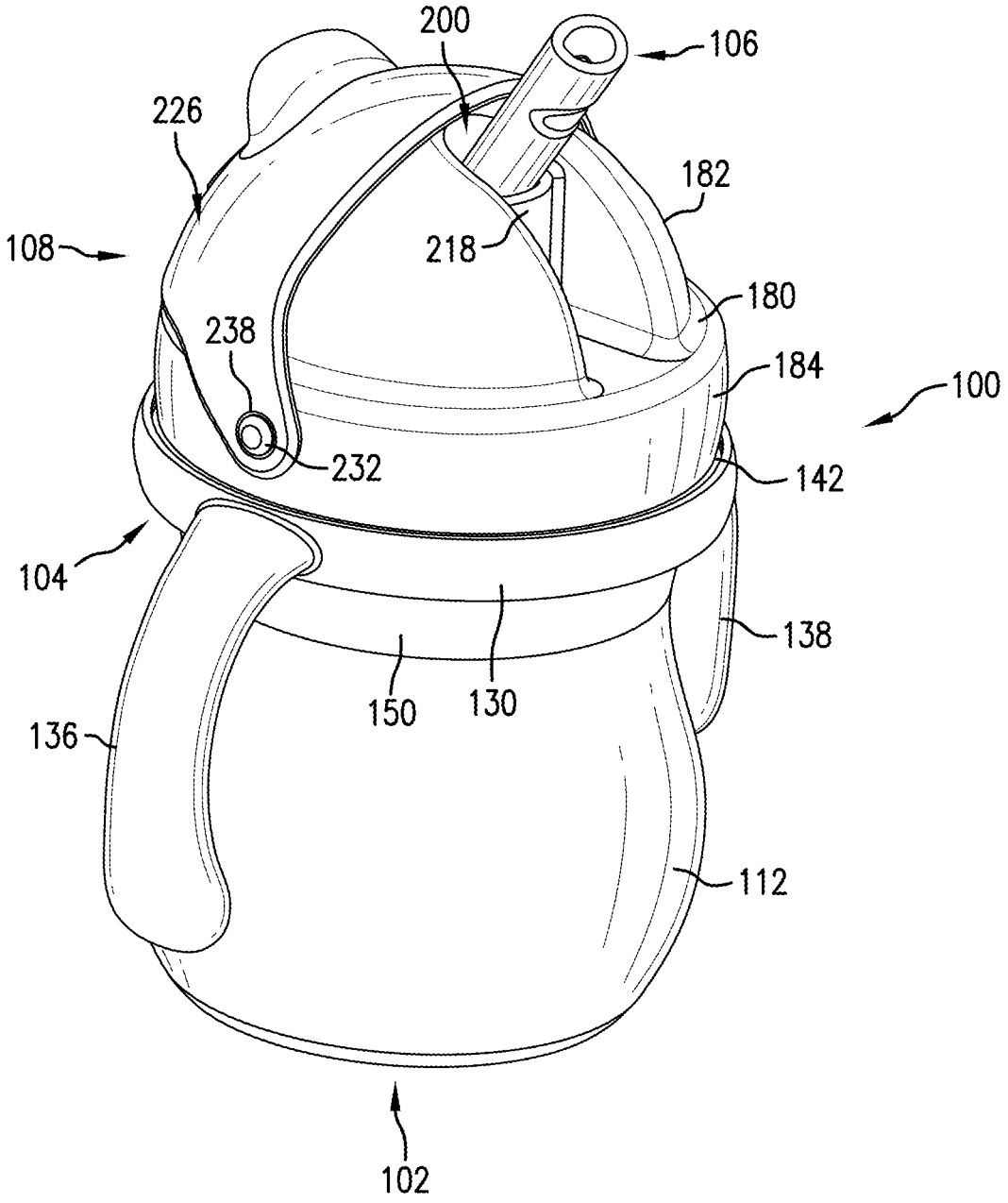
FIG. 1 is a perspective view of a straw cup according to the present disclosure.
Figure 2:
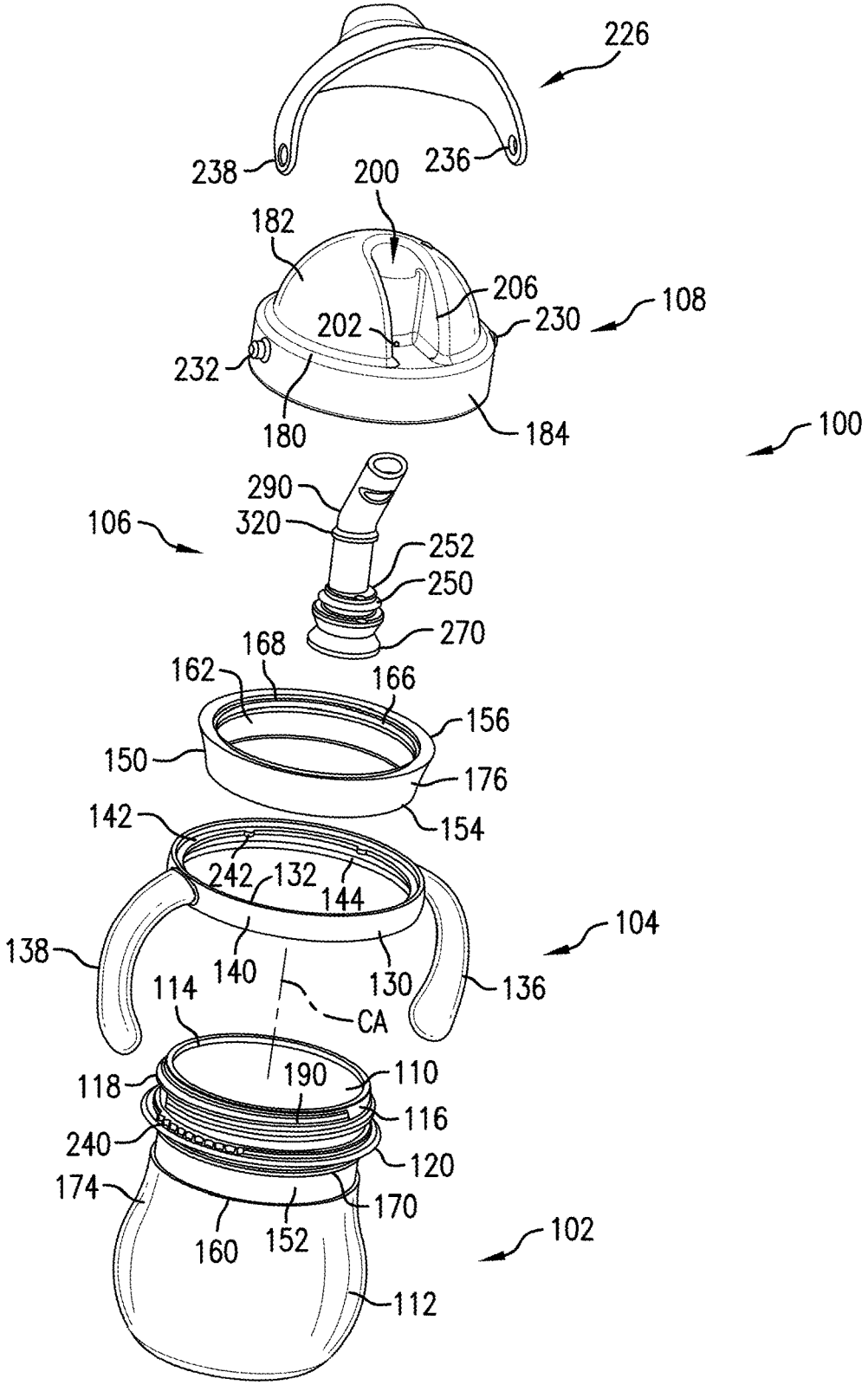
FIG. 2 is an exploded perspective view of the straw cup of FIG. 1.
Figure 3:
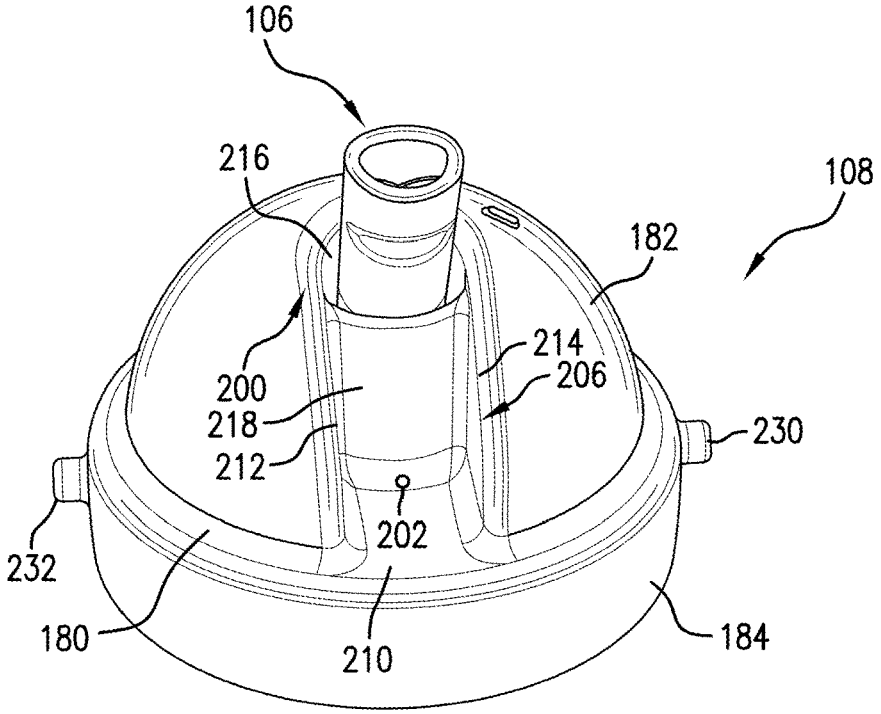
FIG. 3 is a perspective view of a lid and straw of the straw cup of FIG. 1.
Figure 4:
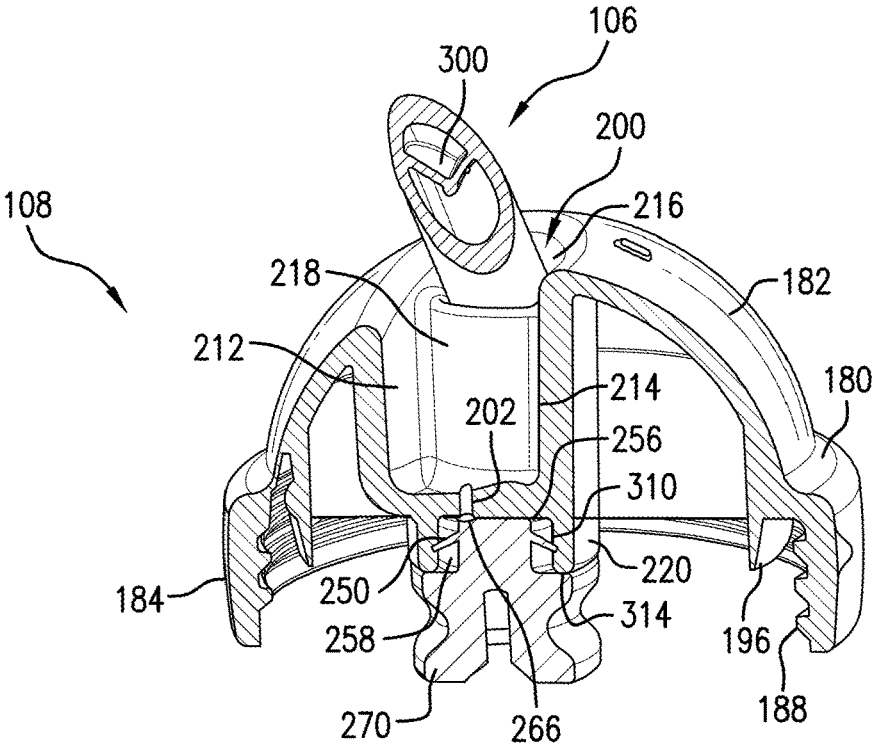
FIG. 4-6 are cross-sectional views of the lid and straw of FIG. 3.
Figure 5:
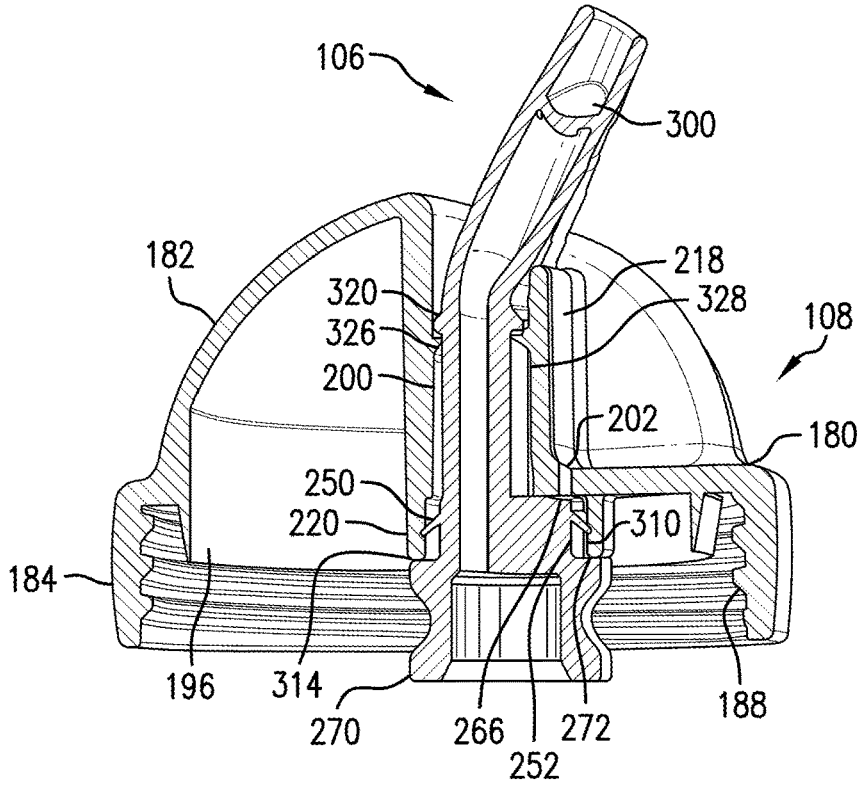
Figure 6:
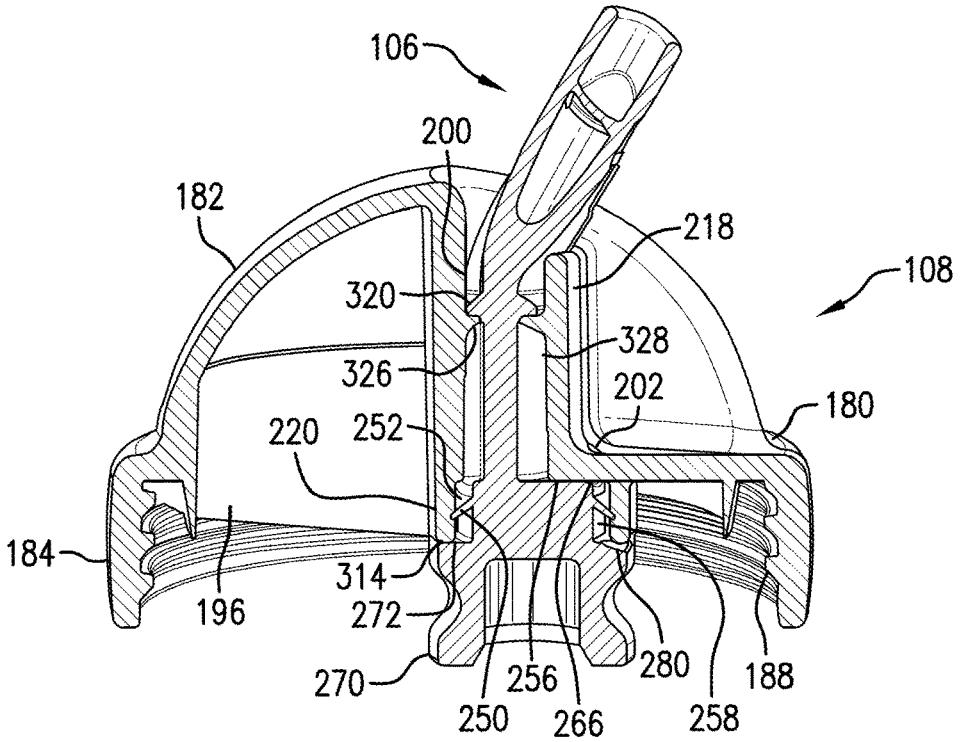
Figure 7:
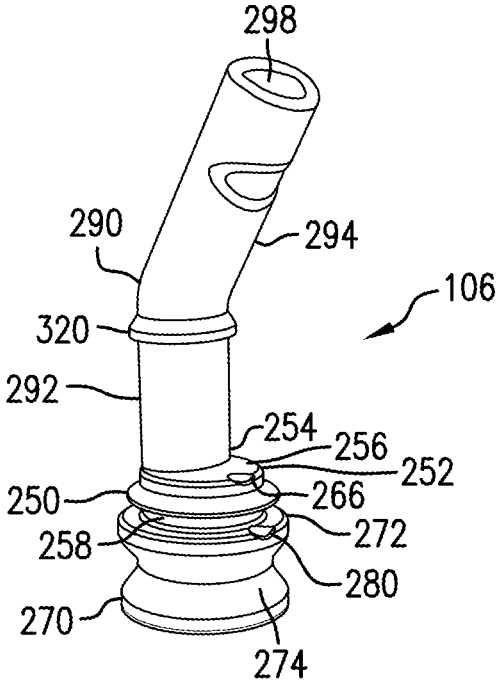
FIGS. 7-9 are perspective views of the straw of the straw cup of FIG. 1.
Figure 8:
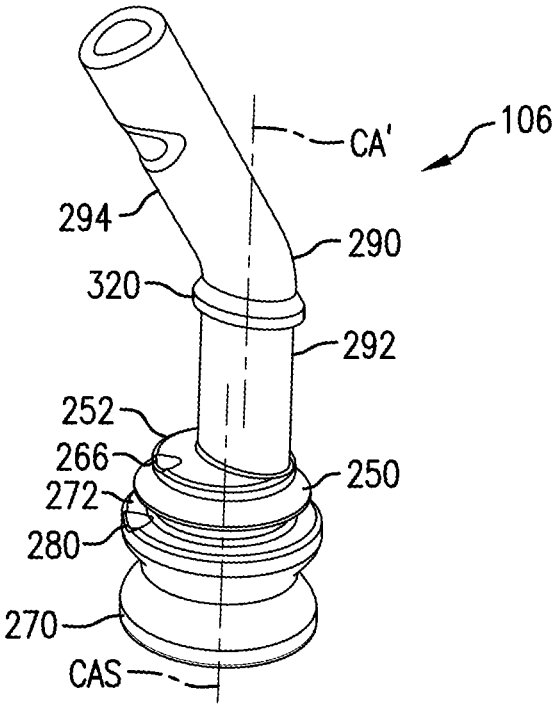
Figure 9:
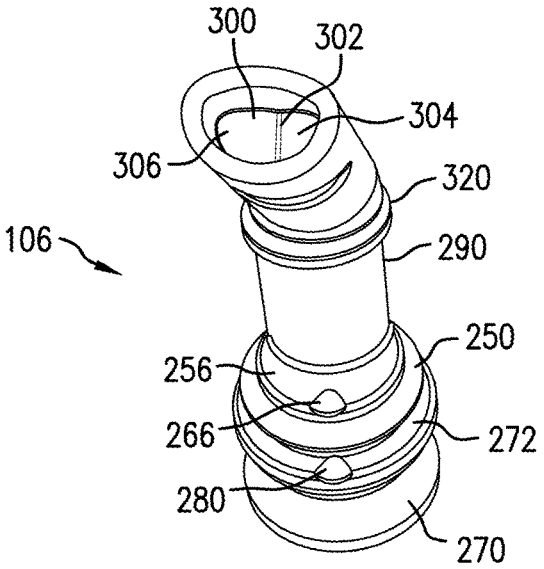
Figure 10:
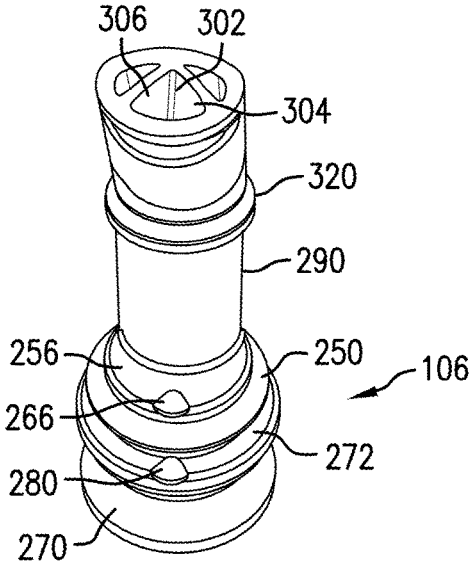
FIGS. 10 and 11 are cross-sectional views of the straw.
Figure 11:
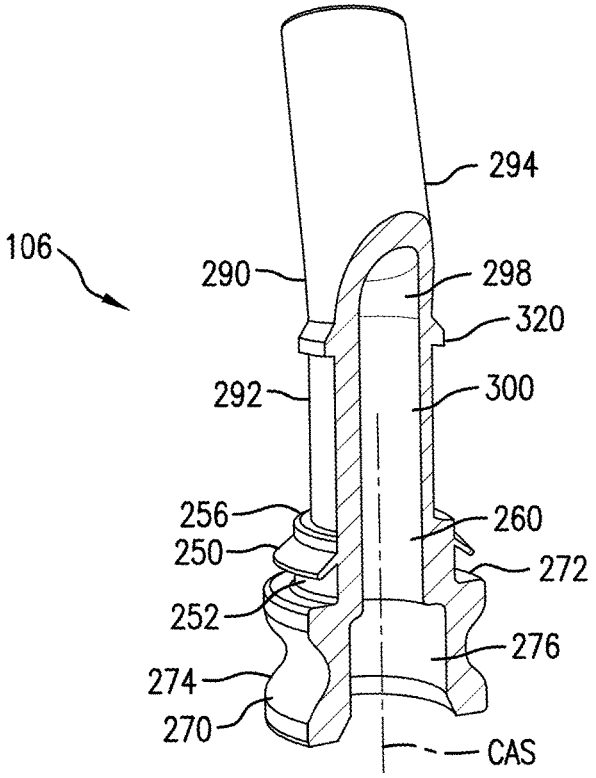

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1 and 2 illustrate an exemplary straw cup 100 including a container 102, a handle assembly 104 mounted to the container, a straw 106, and a cap or lid 108 configured to fit onto the container 102 for closing an open top 110 of the drink container. Each of the container 102, the handle assembly 104 and the lid 108 can be made from a rigid plastic material. Also, the straw 106 can be constructed of a resiliently flexible material such as a polymer or silicone. In the depicted embodiment, the straw cup 100 is a toddler cup, but it should be appreciated that the illustration is by way of example only and that alternative straw cups are contemplated. The container 102 includes a cup portion 112 for retaining a liquid (not shown), a neck 114 having an outer surface 116 provided with external threads 118 and defines a longitudinal axis CA. The drink container 102 further includes an outwardly extending annular collar or shoulder 120 spaced from the external threads 118 and located generally at an interface between the cup portion 112 and the neck 114.

The handle assembly 104 includes a rim 130 with a central opening 132 sized to receive the container neck 114. The rim 130 and central opening 132 are configured to allow the handle assembly 104 to slide axially on and off the container 102, allowing the user to decide on whether or not to use the handle assembly with the straw cup 100. At least one handle is integrally formed with the rim 130 to define a one-piece unit. In the depicted embodiment, a pair of handles 136, 138 are integrally formed with the rim 130. The handles 136, 138 are positioned along an outer portion 140 of the rim 130 and are positioned opposite to each other. According to one aspect, the handles 136, 138 are secured to opposite sides of the rim 130 and positioned 180° apart. In another embodiment, the handle assembly 104 may include more or less than the depicted two handles 136, 138. A flange 142 extends inwardly from an inner portion 144 of the rim 130, and in an assembled condition of the straw cup 100, the rim 130, particularly the flange 142, is supported on the shoulder 120.

As indicated above, the straw cup 100 can be used without the handle assembly 104 attached to the container 102. To assist the user in handling the straw cup 100 sans the handle assembly 104 an elastomeric ring member 150 can be releasably mounted within a circumferential channel 152 located beneath the shoulder 120. As shown, the ring member 150 has an increasing thickness from a lower end portion 154 to an upper end portion 156, the lower end portion 154 supported on an inwardly extending ledge 160 of the channel 152 and the upper end portion 156 abutting an underside of the shoulder. To secure the ring member 150 within the channel 152 an inner surface 162 of the ring member 150 includes a circumferential groove 166 which at least partially defines a circumferential projection 168 at the upper end portion 156. The groove 166 receives a circumferential flange 170 provided within the channel 152 and the projection 168 is fitted between the shoulder 120 and the flange 170. Once secured in the channel 152, an outer surface 174 of the cup portion 112 and an outer surface 176 of the ring member 150 define a substantially continuous outer surface for the container 102.

The lid 108 is releasably attached to the container 102 for closing the container open top 110 thereby preventing liquid in the container 102 from spilling out if the straw cup 100 is tipped over. With reference to FIGS. 3-6, the lid 108 includes a body 180 having a dome shaped top wall 182 and an outer side wall or skirt 184 extending downwardly from the top wall 182. The skirt 184 is cylindrical in configuration in the illustrated embodiment. Internal threads 188 extend inwardly from the skirt 184 for threading onto the complementary external threads 190 located on the container neck 114 to connect the lid 108 with the drink container 102. It should be appreciated that the lid 108 could fit onto the drink container in other conventional manners, e.g., a snap or bayonet connection. It should also be appreciated that when the lid 108 is coupled to the container 102 the handle assembly 104 is held into place by the flange 142 being sandwiched by an edge of the skirt 184 and the shoulder 120. The lid 108 further includes a downwardly extending lower wall 196 which is offset inwardly from the skirt 184. A ring-shaped gasket (not shown) can be received between the lower wall 196 and the skirt 184 to provide a seal between the lid 108 and the container 102 when the lid is connected with the drink container.

The lid body 180 has a dispensing port 200 (which defines a liquid passage) and a vent 202, each extending therethrough and in fluid communication with the open top 110 of the container 102. As depicted, the dispensing port 200 is provided in a recessed or channeled section 206 defined in the top wall 182. Particularly, the section 206 of the top wall 182 is defined by a base wall 210, a pair of opposed side walls 212, 214, and an arcuate shaped end wall 216 interconnecting the side walls. An arcuate shaped intermediate wall 218 spaced from the end wall 216 extends upwardly from the base wall 210 and also interconnects the side walls 212, 214. The end wall 216 and the intermediate wall 218 at least partially define the dispensing port 200. The vent 202 is located on the base wall 210 adjacent the intermediate wall 218. The lid body 180 further includes a downward depending inner collar 220 which surrounds the dispensing port 200.

As shown in FIGS. 1 and 2, a hood 226 is movably connected to the lid 108 for covering the dispensing port 200 including the straw 106 extending outwardly therefrom. It should be appreciated that moving the hood 226 from an opened position to a closed position bends that portion of the straw extending outwardly from the dispensing port 200 over the intermediate wall 218, which can prevent liquid within the container 102 from leaking out through the straw 106. To movably connect the hood 226 to the lid 108, a pair of circumferentially spaced posts 230, 232 is provided on the skirt 184, and the posts are received in corresponding openings 236, 238 provided on the hood 226.

With particular reference to FIG. 2, the container 102 and the handle assembly 104 have a cooperating detent arrangement configured to allow rotational movement of the handle assembly 104 in predetermined increments about the container axis CA. This detent arrangement allows the user to orient the handles 136, 138 correctly with respect to the straw 106 mounted to the lid 108. In the depicted embodiment, the neck 114 of the drink container 102 has a plurality of first detents 240 provided on the outer surface 116 and located at an interface between the shoulder 120 and the container neck 114. The handle assembly 104 has a plurality of second detents 242 shaped to mate with the first detents 240, wherein selective engagement of the first and second detents 240, 242 is configured to allow incremental rotational movement of the handle assembly 104 on the container neck 114 about the container axis CA.

FIGS. 3-6 depict the straw 106 extending through the dispensing port 200 with a lower part of the straw 106 including a flexible seal member 250 for covering the vent 202. The seal member 250 extends downward and outward from the straw and normally contacts an inner part (e.g., the inner collar 220) of the lid body 180. In the illustrated aspect, the seal member 250 extends in a downward and outward direction to the inner part of the lid body 180, having a downward frusto-conical shape, and defines a space between the seal member 250 and the inner part of the lid body 180.

FIGS. 7-11 depict the features of the straw 106 according to the present disclosure. The straw 106 has a mounting member 252 provided at a lower end 254 thereof. The mounting member 252, which can be generally cylindrical shaped, includes an upper surface 256 and a side surface 258 and defines a first fluid passage 260. The seal member 250 extends radially downwardly and outwardly from the side surface 258. Although a frusto-conical shape is shown, the seal member 250 may have any shape that extends downwardly and outwardly to cover the vent 202. According to one aspect, the seal member 250 extends entirely around a circumference of the mounting member 252; although the seal member 250 need not extend entirely around the straw 106.

According to one aspect, the mounting member 252 includes a first cutout or depression 266 in fluid communication with the vent 202. In the depicted embodiment, the first cutout 266 is located on the upper surface 256 and extends toward the side surface 258 with an increasing width dimension on the upper surface 256 (in plan view) and with an increasing depth dimension on the upper surface 256 (as measured relative to the center axis CA). According to one aspect, the mounting member 252 is an upper mounting member and the straw 106 further includes a lower mounting member 270. According to one aspect, the lower mounting member 270 is aligned with the upper mounting member 252 such that center axes CAS defined by the upper and lower mounting members 252, 270 are coincident; although, this is not required. Further, the lower mounting member 270 can have a radial dimension relative to the center axes CAS greater than a radial dimension of the upper mounting member 252.

The lower mounting member 270 includes an upper surface 272 and a side surface 274, and defines a second fluid passage 276 which is in communication with the first fluid passage 260. The lower mounting member 270 further includes a second cutout or depression 280 in fluid communication with the vent 202. In the depicted embodiment, the second cutout 280 is located on the upper surface 272 and extends toward the side surface 274, and can be shaped and sized similar to the first cutout 266. The second cutout 280 can be vertically aligned with and radially offset from the first cutout (as measured relative to the center axes CAS), and the seal member 250 is located between the first and second cutouts 266, 280. In addition, the side surface 274 of the lower mounting member can be concaved which allows for the easy insertion and removal of an end portion of a second straw (not shown) into the second fluid passage 276.

The straw 106 further includes a tubular portion 290 having a first part 292 extending substantially vertically (relative to the center axes CAS) from the upper surface 256 of the mounting member 252 and a second part 294 canted relative to the first part. The tubular portion 290 defines a third fluid passage 298 extending through the first and second parts 292, 294 which is in communication with the first and second fluid passages 260, 276. As depicted, a center axis CA' defined by the first part 292 is offset from the coincident center axes CAS defined by the mounting members 252 and 270, which locates the first part 292 away from the first cutout 266. A valve 300 is located inside the straw 106 and is adapted to restrict the flow of liquid through the tubular portion 290. The valve 300 can be constructed of a resiliently flexible material and spans the interior of the straw with at least one slit 302 extending therethrough. In the illustrated embodiment, the valve 300 is located in the second part 294 and includes first and second valve flap 304, 306 integrally formed with the second part 294 and separated by the slit 302. As is known in the art, the valve 300 is adapted to deform when the user deforms the straw 106 with a hand or mouth or when the user suctions the straw.

With reference back to FIGS. 3-6, with the straw 106 mounted to the lid 108, the tubular portion 290 is received in the dispensing port 200 and the mounting member 252 is received in the inner collar 220. The upper surface 256 of the mounting member 252 contacts the lower end of the dispensing port 200 and the base wall 210, the first cutout 266 being positioned below the vent 202. And in the depicted embodiment, the first cutout 266 is located immediately beneath the vent 202. The side surface 258 of the mounting member 252 is spaced inwardly from an inner surface 310 of the inner collar 220, and an outer end of the seal member 250 normally contacts the inner surface 310. As such, the location where the vent 202 extends through the lid body 180 is located radially between the outer end of the seal member 250 and the tubular portion 290. It should be appreciated that the outer end of the seal member 250 contacts the inner surface 310 in a generally liquid tight engagement. The seal member 250 may also be biased against the inner surface 310, further serving to seal the container 102. It should also be appreciated that if a bias exists, it is not too strong to allow the pressure inside the container 102 to reach a level that is far enough below the atmospheric pressure that it becomes difficult to withdraw fluid through the straw 106.

The upper surface 272 of the lower mounting member 270 engages an end 314 of the inner collar 220. Further, the straw include a sealing ring 320 spaced upward from the mounting member 252 and engaging an inner surface of the dispensing port. As depicted, the sealing ring 320 is at the transition from the first part 292 to the second part 294 of the tubular portion 290 and is seated on or engages an upper surface of a ledge 326 provided on an inner surface 328 of the dispensing port 200. Thus, the straw 106 is restricted from longitudinal (i.e., downward) movement through the dispensing port 200. During assembly, the tubular portion 290 is slid upwardly through the dispensing port 200 until the sealing ring 320 passes the ledge 326 and the flexible seal member 250 engages the inner surface 310 of the inner collar 220.

During use, liquid stored in the container 102 is withdrawn through the straw 106 as the result of a pressure differential across the valve 300. The vent 202 serves to allow air into the container 102, while the seal member 250 restricts the outward movement of liquid through the vent 202. Although the seal member 250 contacts the inner surface 310 of the inner collar 220, over the vent 202, the seal member 250 is sufficiently flexible to allow air into the container 102 when the pressure outside of the container is greater than the pressure inside the container. The seal member 250 is movable radially downwardly and away from the inner surface 310 of the inner collar 220 allowing an inward flow of air through the vent 202 and over the seal member 250 upon the introduction of a pressure differential across the vent 202 where the pressure outside of the container 102 is greater than the pressure inside of the container 102. The upper surface 256 of the mounting member 252 is spaced from the lid body 180 such that an airflow path for the vent 202 is defined between the upper surface of the mounting member and the lid body. More particularly, the first cutout 266 at least partially defines a first airflow path between the upper surface 256 of the mounting member 252 and the lid body 180 and the second cutout 280 at least partially defines a second airflow path between the upper surface 272 of the lower mounting member 270 and the inner collar 220. As mentioned above, the seal member 250 may have a bias towards the inner surface 310 that is sufficient to restrict the flow of liquid from the container 102, when the pressure inside the container 102 is greater than or equal to the pressure outside the container. When the container 102 is inverted, liquid in the container presses the seal member 250 against the inner surface 310, thus further preventing unwanted leakage.

It will be appreciated the above-disclosed features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A straw cup for liquids comprising:

a drink container having an open top;

a lid releasably attached to the container for closing the container open top, the lid including a unitary, one piece body having a dispensing port and a vent each extending therethrough, the body further having a dome shaped top wall, an outer side wall extending downwardly from the top wall and having an internal attachment feature for direct attachment of the body to the container, and an inner collar spaced inwardly from the outer side wall and including a sidewall which depends downward from an inner surface of the body and surrounds the dispensing port;

a straw extending through and outwardly from the dispensing port and having a mounting member provided at a lower end thereof, the mounting member received in the inner collar and including a flexible seal member having a downward frusto-conical shape, the seal member normally contacting an inner surface of the sidewall of the inner collar; and a hood movably connected to the lid for covering the dispensing port including the straw extending outwardly therefrom, wherein the mounting member includes an upper surface and a side surface, the upper surface located adjacent the inner surface of the body, the side surface spaced inwardly from the inner surface of the sidewall of the inner collar, and the seal member extending radially outwardly from the side surface, wherein the seal member is movable radially downwardly and away from the inner surface of the sidewall of the inner collar allowing an inward flow of air through the vent and over the seal member upon the introduction of a pressure differential across the vent where the pressure outside of the container is greater than the pressure inside of the container.

2. The straw cup of claim 1, wherein the mounting member includes a first cutout in fluid communication with the vent.

3. The straw cup of claim 2, wherein the first cutout is located immediately beneath the vent.

4. The straw cup of claim 2, wherein the mounting member upper surface engages the inner surface of the lid body and contacts a lower end of the dispensing port, the first cutout is located on the upper surface.

5. The straw cup of claim 4, wherein the mounting member is an upper mounting member and the straw further includes a lower mounting member having an upper surface engaging an end of the inner collar.

6. The straw cup of claim 5, wherein the upper surface of the lower mounting member includes a second cutout in fluid communication with the vent.

7. The straw cup of claim 6, wherein the second cutout is vertically aligned with and radially offset from the first cutout.

8. The straw cup of claim 6, wherein the seal member is located between the first and second cutouts.

9. The straw cup of claim 6, wherein center axes defined by the upper and lower mounting members are coincident, and the lower mounting member has a radial dimension relative to the center axes greater than a radial dimension of the upper mounting member.

10. The straw cup of claim 1, wherein the straw includes a sealing ring spaced upward from the mounting member and engaging an inner surface of the dispensing port.

11. The straw cup of claim 10, wherein the inner surface of the dispensing port includes a ledge, the sealing ring engaging an upper surface of the ledge.

12. The straw cup of claim 1, wherein the straw includes a first part extending substantially vertically from an upper surface of the mounting member and a second part canted relative to the first part, a center axis defined by the first part is offset from a center axis defined by the mounting member.

13. The straw cup of claim 1, wherein the flexible seal member extends entirely around a circumference of the mounting member.

14. The straw cup of claim 1, wherein the straw further including a valve located inside the straw and spanning the interior of the straw, the valve having at least one slit extending therethrough, the valve located above the flexible seal member.

15. A straw cup for liquids comprising:

a drink container having an open top;

a lid releasably attached to the container for closing the container open top, the lid including a body having a dispensing port and a vent each extending therethrough; and a straw extending through and outwardly from the dispensing port, a lower part of the straw includes a mounting member having a flexible seal member having a downward frusto-conical shape, the seal member normally contacting an inner part of the lid body, and an upper surface of the mounting member is spaced from the lid body such that an airflow path for the vent is defined between the upper surface of the mounting member and the lid body, wherein the seal member is movable radially downwardly and away from the inner part allowing an inward flow of air through the vent and over the seal member upon the introduction of a pressure differential across the vent where the pressure outside of the container is greater than the pressure inside of the container, wherein the straw includes a sealing ring located above the mounting member, the sealing ring extending radially outwardly from an outer side surface of the straw and directly engaging an inner surface of the dispensing port.

16. The straw cup of claim 15, wherein the lid body includes a downward depending inner collar which surrounds the dispensing port, the mounting member is received within the inner collar, the seal member provided on a sidewall of the mounting member and extending entirely around a circumference of the mounting member, the sidewall spaced from an inner surface of the inner collar and the seal member normally contacting the inner surface of the inner collar.

17. The straw cup of claim 16, wherein the mounting member includes a cutout located on the upper surface and extending toward the sidewall, the cutout in fluid communication with the vent, wherein the cutout at least partially defines the airflow path between the upper surface of the mounting member and the lid body.

18. The straw cup of claim 17, wherein the mounting member is an upper mounting member and the straw further includes a lower mounting member having an upper surface engaging an end of the inner collar, the upper surface of the lower mounting member includes a second cutout in fluid communication with the vent, wherein the second cutout at least partially defines a second airflow path between the upper surface of the lower mounting member and the inner collar.

19. The straw cup of claim 18, wherein the second cutout is vertically aligned with and radially offset from the first cutout relative to a center axis defined by the upper mounting member, and the seal member is located between the first and second cutouts.

* * * * *